United States Patent [19]

Lemaire

[11] Patent Number: 4,926,555

[45] Date of Patent: May 22, 1990

[54] POCKET KNIFE

[75] Inventor: Denis J. Lemaire, Boucherville, Canada

[73] Assignee: Wenger SA, Delémont, Switzerland

[21] Appl. No.: 394,520

[22] Filed: Aug. 16, 1989

[51] Int. Cl.[5] ..... B26B 1/00

[52] U.S. Cl. ..... 30/162; 30/163

[58] Field of Search ..... 30/160–163, 30/329, 337, 338

[56] References Cited

U.S. PATENT DOCUMENTS

| | | | |
|---|---|---|---|
| 307,767 | 11/1884 | Heysinger | 30/163 X |
| 1,859,158 | 5/1932 | Pernek | 30/163 |
| 4,006,514 | 2/1977 | Penman | 30/161 |

*Primary Examiner*—Douglas D. Watts

*Attorney, Agent, or Firm*—Goodman & Teitelbaum

[57] ABSTRACT

The present disclosure describes a pocket knife. The pocket knife comprises a pair of bolster linings superposedly fixed to each other and defining a space therebetween, a cutting blade slidably mounted in the space relative to one of the linings and adjacent thereto, a leaf spring fixed to the other lining in the space, one end of the leaf spring adapted to abut against the end of the blade when the latter is projecting partly out of the linings, a knob connected to the end of the blade and extending out of a slot provided through the first lining, the knob being pivotingly connected to the end of the blade and adapted to push on the leaf spring and retract the latter from abutment with the end of the blade.

2 Claims, 2 Drawing Sheets

POCKET KNIFE

This invention relates to a pocket knife.

The present invention is directed to a pocket knife similar to the one described in the Canadian patent application No. 574,518, made by the same inventor, Denis Lemaire.

One problem of this pocket knife described in the Canadian patent application No. 574,518 is that the construction of the knife is relatively complex.

An object of the present application is to provide a pocket knife of simpler construction.

According to the present invention, there is provided a pocket knife comprising a pair of bolster linings superposedly fixed to each other and defining a space therebetween, a cutting blade slidably mounted in said space relative to one of said linings and adjaent thereto, a leaf spring fixed to the other lining in said space, one end of said leaf spring adapted to abut against the end of said blade when the latter is projecting partly out of said linings, a knob connected to the end of said blade and extending out of a slot provided through said first lining, the said knob being pivotingly connected to the end of said blade and adapted to push on said leaf spring and retract the latter from abutment with the end of the blade.

According to the present invention, there is also provided a pocket knife comprising a pair of bolster linings superposedly fixed to each other and defining a space therebetween, a cutting blade slidably mounted in said space relative to one of said linings and adjacent thereto, a leaf spring incorporated in the other lining, one end of said leaf spring adapted to abut against the end of said blade when the latter is projecting partly out of said linings, a knob connected to the end of said blade and extending out of a slot provided through said first lining, the said knob being pivotingly connected to the end of said blade and adapted to push on said leaf spring and retract the latter from abutment with the end of the blade.

The objects, advantages and other features of the present invention will become more apparent upon reading of the following non-restrictive description of these further preferred embodiments thereof, given for the purpose of exemplification only with reference to the accompanying drawings.

Figure 1:
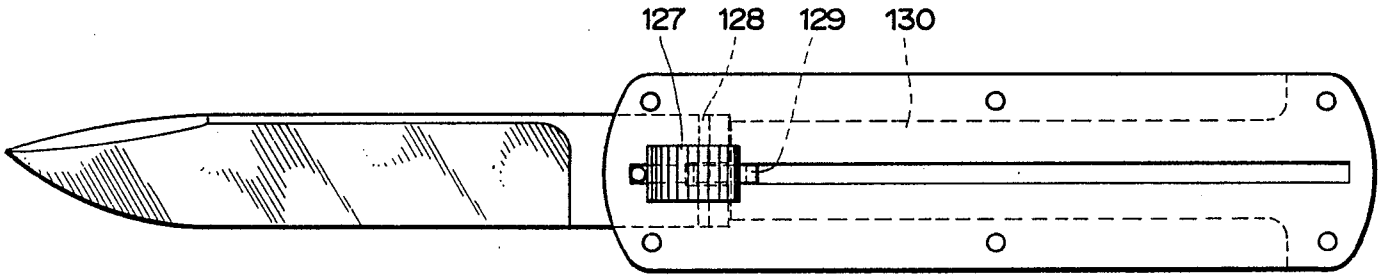
FIG. 1 is a plan view of a further embodiment of a pocket knife according to the invention.
Figure 2:
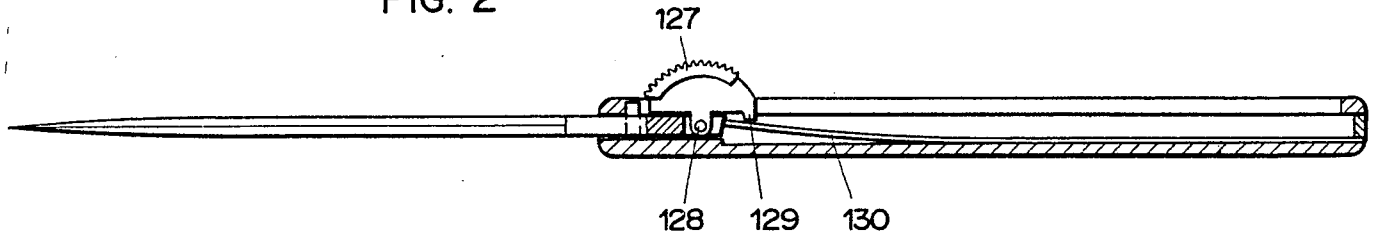
FIG. 2 is a bottom view of the knife according to FIG. 1.

In FIGS. 1 and 2, there is shown an embodiment of a pocket knife. A button 127 pivotingly connected to the rearward end of the blade by means of an arbor 128 has a nose 129. The leaf spring 120 rests against the rearward end of the blade of the knife and prevents the blade from being pushed in. By twisting the button 127, the nose 129 presses on the leaf spring 120 and thereby releases the blade. The blade can now be sunk into the knife with the aid of the button 127. In this exemplified embodiment, the leaf spring 120 is, as FIG. 2 clearly shows, disposed substantially parallel to the blade in the interior of the casing of the knife.

Figure 3:
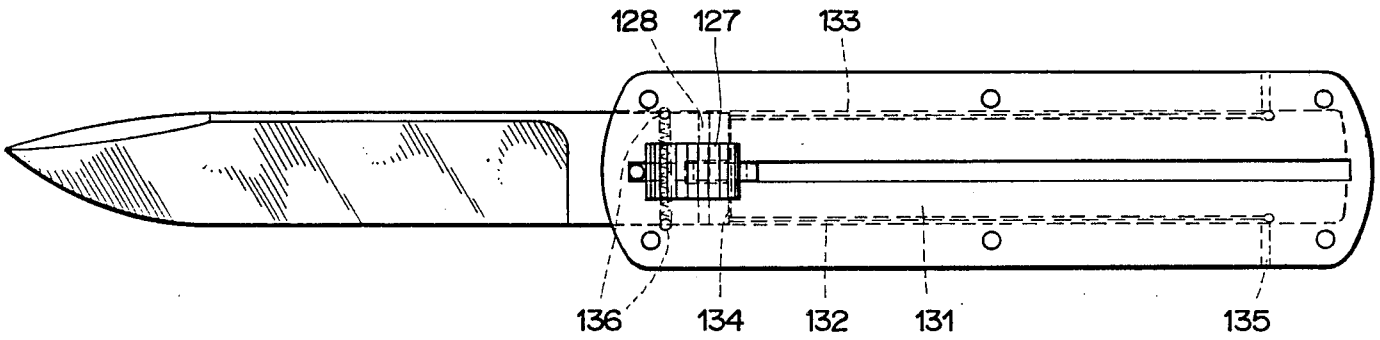
FIG. 3 is a plan view of another embodiment of a pocket kniefe according to the invention.
Figure 4:
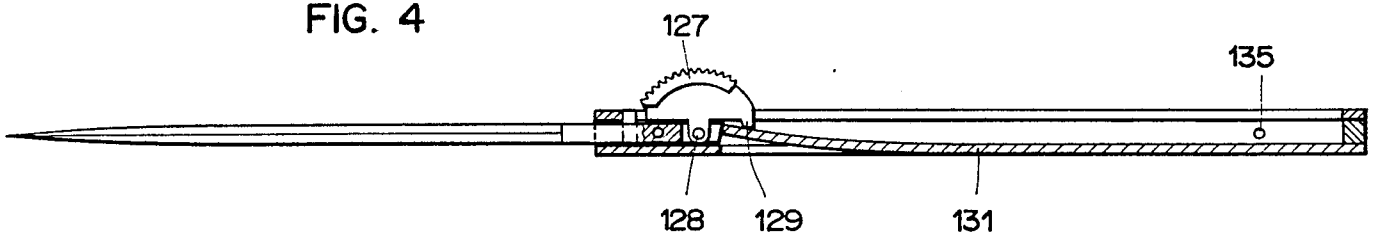
FIG. 4 is a bottom view of the knife according to FIG. 3.

In FIGS. 3 and 4, there is shown another embodiment of a pocket knife according to the invention. The knife roughly corresponds to that of FIGS. 1 and 2. Instead of a leaf spring 120 inserted into the casing, a leaf spring 131 is incorporated in a half of the casing. The half-casing having the leaf spring 131 is made in one piece and has a U-shaped, slot-like groove consisting of the base leg 134 and the two legs 132, 133. The leaf spring 131 thereby exposed is subsequently biased in such a way that when the blade of the knife is extended, it engages the rearward end of the blade, as already described in the preceding example. The leaf spring is releasable from the rearward end of the blade by means of the button 127 and the nose 129, and the blade can be pushed into the inside of the knife.

A loading ball bearing 136 falls into a hole 135 in the blade tang to prevent the blade from coming out of the handle by itself.

The embodiments of the invention in which an exclusive property or privilege is claimed are defined as follows:

1. A pocket knife comprising a pair of bolster linings superposedly fixed to each other and defining a space therebetween, a cutting blade slidably mounted in said space relative to one of said linings and adjacent thereto, a leaf spring fixed to the other lining in said space, one end of said leaf spring adapted to abut against the end of said blade when the latter is projecting partly out of said linings, a knob connected to the end of said blade and extending out of a slot provided through said first lining, the said knob being pivot connected to the end of said blade and adapted to push on said leaf spring and retract the latter from abutment with the end of the blade.

2. A pocket knife comprising a pair of bolster linings superposedly fixed to each other and defining a space therebetween, a cutting blade slidably mounted in said space relative to one of said linings and adjacent thereto, a leaf spring incorporated in the other lining, one end of said leaf spring adapted to abut against the end of said blade when the latter is projecting partly out of said linings, a knob connected to the end of said blade and extending out of a slot provided through said first lining, the said knob being pivotingly connected to the end of said blade and adapted to push on said leaf spring and retract the latter from abutment with the end of the blade.

* * * * *